United States Patent [19]

Engle

[11] Patent Number: 4,541,353

[45] Date of Patent: Sep. 17, 1985

[54] DUAL-CHAIN SEWING MACHINE

[75] Inventor: Elbert Engle, Ashville, Ala.

[73] Assignee: Chesebrough-Pond's, Inc., Conn.

[21] Appl. No.: 569,049

[22] Filed: Jan. 9, 1984

[51] Int. Cl.[4] ..... D05B 27/00; D05B 21/00; B65G 25/00; B65H 39/00

[52] U.S. Cl. ..... 112/304; 112/121.26; 112/121.15; 112/306; 112/305; 26/96; 270/52; 271/18.3; 271/277; 198/692; 198/820

[58] Field of Search ..... 112/121.26, 121.27, 112/304, 305, 306, 308, 303; 26/96; 34/158, 162; 493/379; 83/423, 151, 155; 198/692, 820; 271/18.3, 277, 141; 270/52, 58

[56] References Cited

U.S. PATENT DOCUMENTS

| | | | |
|---|---|---|---|
| 37,687 | 2/1863 | Gordon . | |
| 186,423 | 1/1877 | Jacoby . | |
| 406,896 | 7/1889 | Frese . | |
| 1,065,309 | 6/1913 | Ginaca . | |
| 1,222,110 | 4/1917 | Lahti . | |
| 1,267,397 | 5/1918 | Garbow . | |
| 1,297,108 | 3/1919 | Cunningham . | |
| 1,800,604 | 4/1931 | Cluett | 26/96 |
| 2,235,960 | 3/1941 | Curtis . | |
| 2,252,735 | 8/1941 | Sherman . | |
| 2,568,028 | 9/1951 | Redmond . | |
| 2,619,175 | 11/1952 | Gottlieb | 271/18.3 |
| 2,896,944 | 7/1959 | Shuhei Shiba | 271/259 X |
| 2,916,899 | 12/1959 | Hepp et al. | 26/96 X |
| 2,947,917 | 8/1960 | O'Brien | 271/258 |
| 2,973,202 | 2/1961 | Schmeck et al. | 271/259 |
| 2,974,699 | 3/1961 | Boles et al. . | |
| 3,089,526 | 5/1963 | Lykkeberg . | |
| 3,140,736 | 7/1964 | Propst . | |
| 3,253,824 | 5/1966 | Southwell et al. | 271/19 |
| 3,289,510 | 12/1966 | Carter et al. | 26/96 X |
| 3,406,961 | 10/1968 | Walton | 271/10 |
| 3,456,537 | 7/1969 | Quinn | 83/162 |
| 3,514,352 | 5/1970 | Judge, Jr. | 26/96 X |
| 3,552,248 | 1/1971 | Pernick | 83/151 |
| 3,669,048 | 6/1972 | Dunn et al. | 112/121.26 |
| 3,765,672 | 10/1973 | Conner, Jr. | 271/10 |
| 3,841,623 | 10/1974 | McCarthy et al. | 271/126 |
| 3,866,499 | 2/1975 | Messner | 83/151 X |
| 4,049,257 | 9/1977 | Frystak | 271/126 X |
| 4,127,266 | 11/1978 | Williams | 271/277 X |

(List continued on next page.)

FOREIGN PATENT DOCUMENTS

| | | | |
|---|---|---|---|
| 2739653 | 3/1979 | Fed. Rep. of Germany | 271/258 |

OTHER PUBLICATIONS

Fabric Handling for Automated Manufacturing of Garments, by R. Dubey and J. Parker, Memo to: Dr. F. W. Paul from R. Dubey and J. Parker dated 10/15/81.

(List continued on next page.)

*Primary Examiner*—H. Hampton Hunter

*Attorney, Agent, or Firm*—Brumbaugh, Graves, Donohue & Raymond

[57] ABSTRACT

A dual-chain sewing machine for aligning the edges and the corresponding seam tracks of pieces of a garment that have different curvatures and for sewing the pieces together along the seam tracks includes two flexible, elongated carriers, which move at approximately the same linear speed and which are mounted and arranged for motion around continuous paths. Each carrier has pins extending from it in a direction transverse to the direction of movement, with the pins of one carrier extending toward the pins of the other carrier. A first fabric piece is applied to the pins of the first carrier when a pin bearing portion of the first carrier is in a path segment corresponding to the seam track on the first fabric piece; a second fabric piece is applied to the pins of the second carrier when a pin bearing portion of the second carrier is in a path segment corresponding to the seam track on the second fabric piece. The second carrier is guided toward the first carrier so that the pins of the first carrier engage the second fabric piece, and then the second carrier is guided away from the first carrier. Consequently, the second fabric piece is transferred from the second carrier to the first carrier and aligned with the first fabric piece already on the pins of the first carrier. The first carrier transports the fabric pieces to a sewing machine, which sews them together along the desired seam track.

11 Claims, 15 Drawing Figures

U.S. PATENT DOCUMENTS

| | | | |
|---|---|---|---|
| 4,157,825 | 6/1979 | Ellenberger et al. | 271/10 |
| 4,203,590 | 5/1980 | Blessing | 271/277 |
| 4,214,741 | 7/1980 | Crawford | 271/18.3 |
| 4,283,047 | 8/1981 | Blessing | 271/18.3 |
| 4,348,018 | 9/1982 | Bijttebier et al. | 271/10 |

OTHER PUBLICATIONS

Robotic Fabric Handling for Automated Garment Manufactured by: Engineering Center for Automated Manufacturing Technology.

Fabric Handling for Automated Manufacturing of Garments 'CAM' 82-100 by: Mechanical Eng. Dept., College of Eng., Clemson University.

DUAL-CHAIN SEWING MACHINE

BACKGROUND OF THE INVENTION

This invention relates to an apparatus and a method for automatically sewing portions of a garment. In particular, the invention concerns an apparatus and a method for sewing garment portions along seams which follow seam tracks on the garment portions having different curvatures.

My copending application, Ser. No. 571,120, filed on Jan. 17, 1984, (the disclosure of which is hereby incorporated by reference herein) describes an apparatus for automatically mating and sewing together fabric plies, which are to form part of a garment. In the apparatus described therein, the fabric plies are sewn along a curved seam track that follows a curved path which has the same curvature on each ply when the two material plies to be mated are flat and relaxed (not stretched) in their mated configuration. Accordingly, the material plies can be placed together automatically in a flattened condition, transported together to a sewing machine and past the sewing head of the sewing machine, thereby forming a seam along the seam track between the fabric plies.

In addition to such simple sewing operations, the fabrication of clothing requires more complex sewing operations wherein material plies must be joined along seam tracks which follow a different curvature on each of the plies. For purposes of example, the seam which joins the shoulder of a T-shirt to the sleeve of a T-shirt must be sewn along a seam track on the mated front and back of the T-shirt, which can be described as a "concave" edge, labeled 20 in FIG. 11. The concave edge 20 must be mated and joined to what will be described as a convex edge 22, which is visible in FIG. 11 for the sleeve ply in the relaxed state.

The sewing operation to join the sleeve to the shirt front and back is normally performed by a sewing machine operator, who must bring the edges together along the seam track as the sewing operation progresses. It is an object of the present invention to provide a machine which will automatically mate plies along the different seam track and join the plies following a different seam track curvature on the two plies.

SUMMARY OF THE INVENTION

In accordance with the invention there is provided an apparatus for sewing first and second fabric plies along first and second seam tracks on the plies. The apparatus includes a first flexible, elongated carrier mounted and arranged for motion around a first continuous path. The first carrier has pins projecting from at least a portion thereof in a first transverse direction. The first path has a first path segment corresponding to the first seam track and a second path segment. The apparatus further includes a second flexible, elongated carrier mounted and arranged for motion around a second continuous path. The second path has a third path segment corresponding to the second seam track and a fourth path segment generally parallel to and along said second path segment. The second carrier has pins projecting from at least a portion thereof in a second transverse direction, the second transverse direction being substantially opposite to the first transverse direction. Therefore, the pins of the second carrier extend toward the first carrier when the pin bearing portions of the first and second carriers are at the second and fourth segments of the paths, respectively. There is also provided fabric applying means associated with the first and second carriers for positioning the fabric plies along the first and second seam tracks to engage the pin bearing portions of the first and second carriers when the pin bearing portions are along the first and third path segments, respectively. There is also provided a carrier transport means for transporting the first and second carriers with substantially identical linear speed and fabric guiding means for mating the pin engaged fabric plies along the second and fourth path segments in response to transport of the first and second carriers. Finally, there is provided sewing apparatus for receiving and sewing the mated fabric plies.

In a preferred embodiment of the invention, the first and second carriers comprise chains having chain links joined by link connecting pins with link connecting axes, and the pins extend from the chains parallel to the axes. Each of the fabric applying means may comprise a surface having a groove along one of the first and third path segments, the grooves being arranged to receive the pins. The surfaces may be arranged to be moveable toward and away from the corresponding carrier in order to apply the fabric to the pins. In the embodiment wherein the first and second carriers comprise chains, the carrier transport means may be a motor with a shaft having first and second sprockets for driving the first and second chains at approximately the same linear speed.

The first carrier is advantageously arranged in a first guide along the second segment with the first carrier pins extending outwardly from the first guide. The first carrier pins extend into first and second serially arranged fabric guiding slots along the second segment. The second carrier may be arranged in a second guide along the fourth segment with the second carrier pins extending outwardly from the second guide and into a third fabric guiding slot, which intersects the first slot at an acute angle, and the second slot. The third slot is serially arranged with the second slot; accordingly, when the transport means moves the carriers and the first fabric ply is guided through the first and second slots, the second fabric ply is guided through the third and second slots (in that order) and mated with the first ply in the second slot. In an illustrative embodiment, the second guide is arranged to move the second carrier toward the first carrier in a portion of the fourth segment corresponding to the third slot and away from the first carrier in a portion of the fourth segment corresponding to the second slot, thereby disengaging the second fabric ply from the second carrier.

In accordance with one aspect of the invention, a fabric handling apparatus includes a first elongated carrier having transversely extending pins and being arranged for elongated motion along a first path serially through first and second fabric guiding slots with the pins extended into the slots. The apparatus also includes a second elongated carrier having transversely extending pins and being arranged for elongated motion along a second path serially through a third fabric guiding slot and the second fabric guiding slot with the pins extending into the slots toward the pins of the first carrier.

In accordance with the invention, there is provided a method for mating a first fabric ply to a second fabric ply along associated first and second seam tracks on the plies. The method includes the steps of engaging the first ply along the first seam track with transverse pins on a first elongated flexible carrier, engaging the second ply along the second seam track with transverse pins on a second elongated flexible carrrier, flexing at least one of the carriers in the region of the associated seam track to have a shape corresponding to the other of the carriers, and bringing the carriers together with the pins of one carrier facing the pins of the other carrier, thereby mating the plies along the tracks.

For a better understanding of the present invention, together with other and further objects, reference is made to the following detailed description, taken in conjunction with the accompanying drawings, and the scope of the present invention will be pointed out in the appended claims.

DETAILED DESCRIPTION OF THE PREFERRED EMBODIMENT

Figure 1:
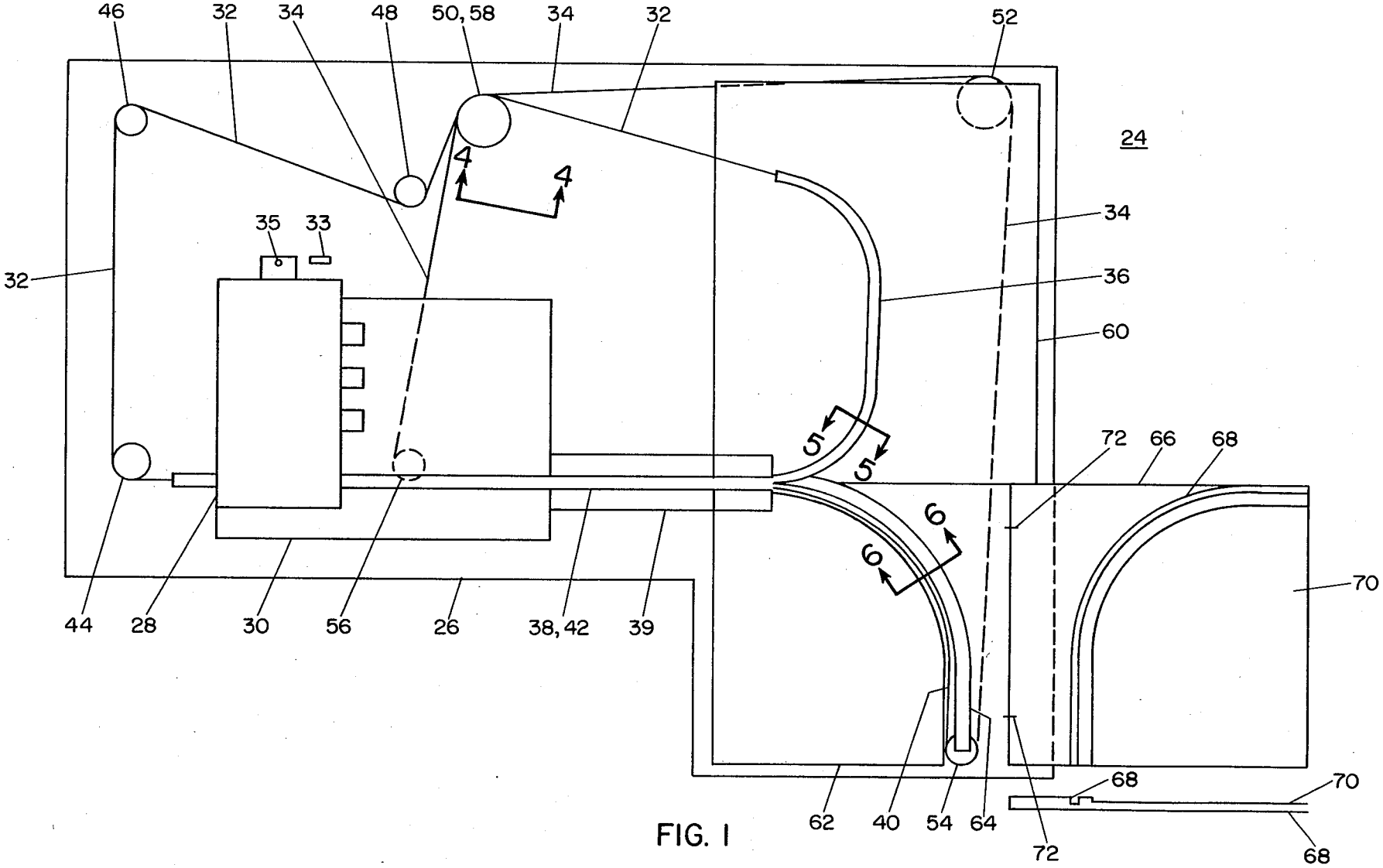
FIG. 1 is a top view of a sewing apparatus in accordance with the present invention.
Figure 2:
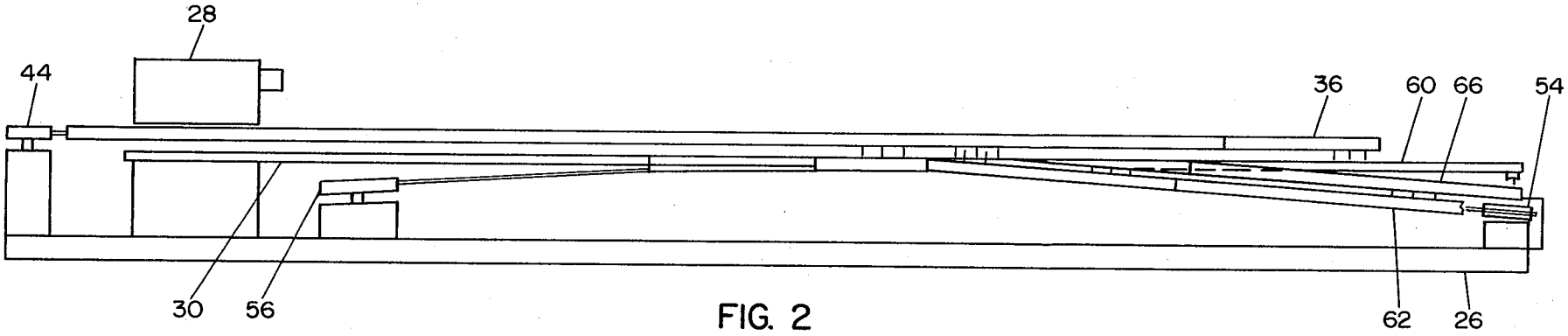
FIG. 2 is a side view of the sewing apparatus of FIG. 1.
Figure 3:
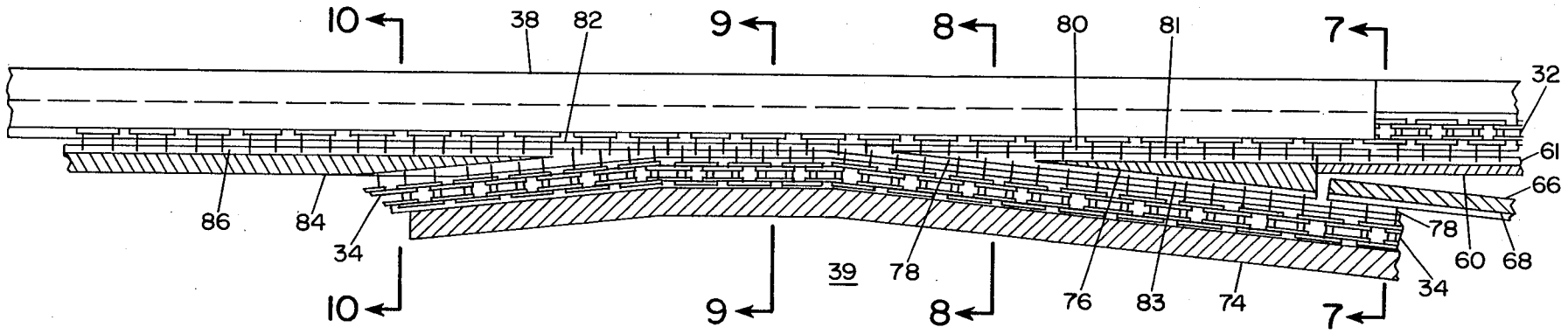
FIG. 3 is a cross-sectional view of the apparatus of FIGS. 1 and 2.

In the Figures, like reference numerals designate like elements. An exemplary embodiment of an apparatus in accordance with the invention is illustrated in FIGS. 1 and 2. The apparatus shown in these figures sews the sleeves of a garment onto a partially fabricated garment portion, which includes the front and the back pieces of the garment joined at the shoulder seam.

Figure 11:
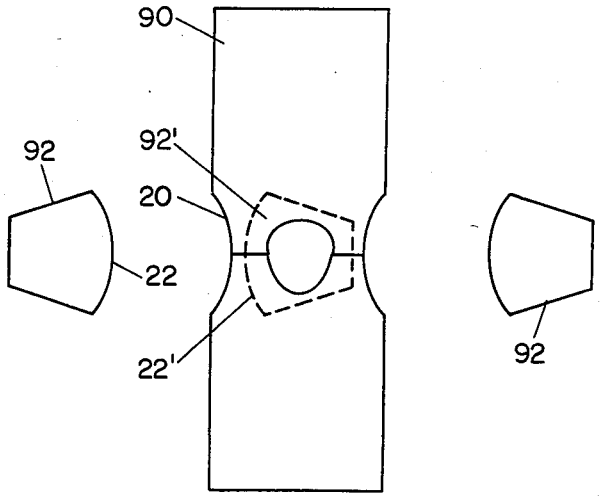
FIG. 11 is a simplified diagram illustrating garment portions to be sewn together for the manufacture of a T-shirt.

More specifically, and with reference to FIG. 11, the apparatus depicted in FIGS. 1 and 2 is arranged to sew the edge 20 of the joined front and back pieces 90 to the edge 22 of the sleeve 92. As is illustrated by the dotted sleeve portion 22, when the fabric pieces 90 and 92 are positioned to be sewn together, the edge 22' is convex while the edge 20, i.e., the edge to which the edge 22' must be mated, is concave. Thus, to achieve a properly formed and shaped seam that joins the sleeve 92 to the partially fabricated garment portion 90, the fabric pieces 90 and 92 must be constantly brought together during the sewing operation. For the fabric pieces depicted in FIG. 11, the desired seam track on the garment portion 90 is slightly spaced from and follows the curvature of the edge 20; likewise, the desired seam track on the sleeve 92 is slightly spaced from and follows the curvature of the edge 22.

The dual-chain sewing machine 24 shown in FIGS. 1 and 2 is supported on a platform 26 and includes a first pin bearing chain 32 and a second pin bearing chain 34, each chain being mounted and arranged to follow a continuous closed path around the apparatus 24. The first chain 32 follows a path including a first path segment, which is defined by the chain-guiding member 36, and a second path segment, which is defined by the chain-guiding member 38. The second chain 34 follows a path through a third path segment 40, which is defined by the plates 62 and 64, and a fourth path segment 42, which is defined by the chain-guiding member 74. The fourth path segment is aligned with the second path segment in a fabric-mating section 39 of the apparatus 24. The first path segment has a shape corresponding to the seam track on the fabric ply 90, while the third path segment has a shape corresponding to the seam track on the fabric ply 92. As will be described in detail below, the fabric piece 90 is engaged along the first path segment by a pin bearing portion of the chain 32, and the fabric piece is engaged along the third path segment by a pin bearing portion of the chain 34. The fabric pieces are transported in unison and brought together, or mated, along the desired seam tracks in the fabric-mating section 39 corresponding to the second path segment and the fourth path segment. In this section of the apparatus, the fabric piece 92 is transferred to the first chain 32, and then both fabric pieces 90, 92 are moved by the chain 32 to a sewing machine 28, which is mounted on a platform 30. The sewing machine 28 sews the aligned fabric pieces 90, 92 together along the desired seam track.

Figure 13:
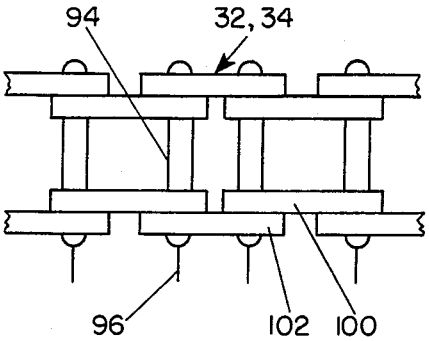
FIG. 13 is a detailed view of a portion of the chains used in the FIG. 1 apparatus.

As indicated above, pin bearing portions of the chains 32 and 34 engage the fabric pieces 90 and 92, respectively, in the apparatus illustrated in FIGS. 1 and 2; however, any elongated, flexible carrier with transverse pins for engaging fabric pieces may be used in an apparatus according to the present invention. Further, the carrier is preferably provided with pins along its entire length. For convenience and ease of illustration, the apparatus will hereinafter be described as having chains for the flexible, elongated carriers with pins along their entire length. FIG. 13 shows a part of a chain 32, 34 that may be used in an apparatus according to the present invention. The chain 32, 34 has link connecting pins 94 connecting inner links 100 and outer links 102. The link connecting pins 94 enable the links 100 and 102 to pivot about axes that are coaxial with the link connecting pins 94. The chain further includes pins 96 for engaging fabric plies. The pins 96 extend from the chain in a direction parallel to the axes, which is a direction transverse to the direction of movement of the chain.

Figure 4:
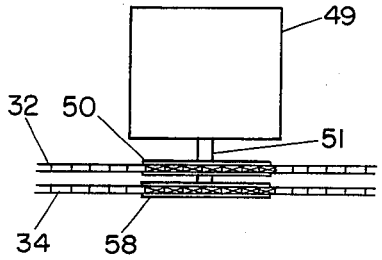
FIG. 4 is a detailed view of a portion of the FIG. 1 apparatus.

Referring again to FIGS. 1 and 2, the first chain 32 is supported along its associated continuous path by the sprockets 44, 46, 48, and 50, while the second chain 34 is supported along its associated continuous path by the sprockets 52, 54, 56, and 58. The chains 32 and 34 may be driven or transported at approximately the same linear speed along their respective paths by the motor-sprocket arrangement illustrated in FIG. 4. The sprockets 50, for the first chain 32, and 58, for the second chain 34, are mounted on a shaft 51 of a motor 49. Such a motor-sprocket arrangement operates to move the chains 32 and 34 synchronously so that the fabric pieces 90 and 92 move in unison. Preferably, the motor 49 is a stepper motor, and a magnetic sensor 33 is mounted adjacent magnet 35 on the shaft of machine 28 to sense the operating speed of the sewing machine and provide control pulses to the stepper motor for coordinating the operation of the sewing machine 28 and the chains 32 and 34 at least *during* the time period when the chain is transporting fabric plies past the sewing head of machine 28. Such operation may be controlled by a microprocessor, as described in my copending application.

Figure 5:
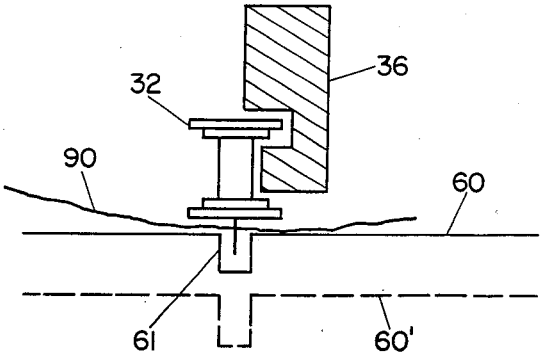
FIG. 5 is a cross-sectional view of a portion of the FIG. 1 apparatus.
Figure 6:
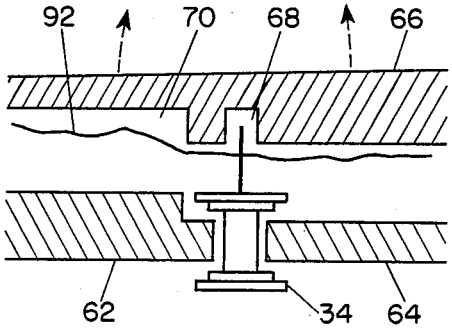
FIG. 6 is another cross-sectional view of a portion of the FIG. 1 apparatus.
Figure 7:
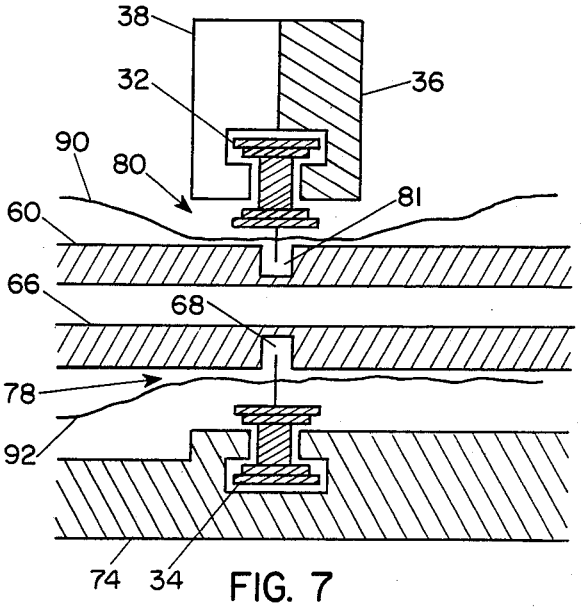
FIG. 7 is another cross-sectional view of a portion of the FIG. 1 apparatus.
Figure 8:
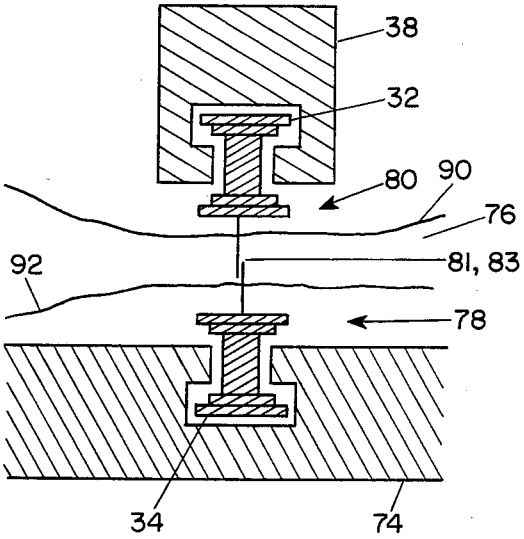
FIG. 8 is another cross-sectional view of a portion of the FIG. 1 apparatus.
Figure 9:
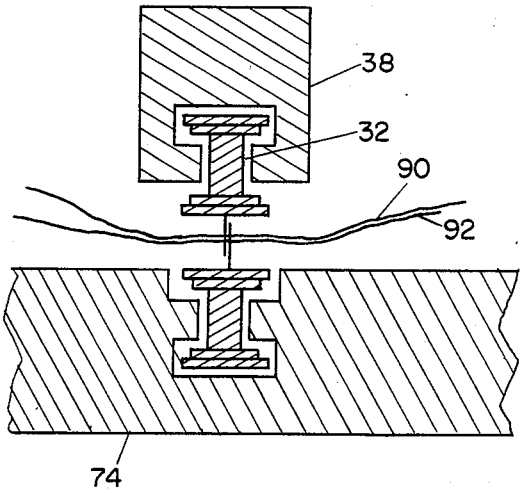
FIG. 9 is another cross-sectional view of a portion of the FIG. 1 apparatus.

The dual-chain sewing machine shown in FIGS. 1 and 2 also includes apparatus for applying the fabric pieces 90 and 92 to the pin bearing portions of the chains 32 and 34, respectively, when the pin bearing portions of the chains are located in the first path segment and the third path segment, respectively. More particularly, a plate 66, with a groove 68 and a cutaway portion 70, is mounted on the plate 64 by hinges 72. The groove 68 corresponds to the third path segment. The fabric piece 92 is placed over the pin bearing chain 34 with the seam track over the third path segment 40, and the plate 66 is rotated about the hinges 72 so that the fabric piece 92 is pressed onto the pins 96 of the second chain 34 as the pins 92 enter the groove 68. FIG. 6 better illustrates the operation of the rotatable plate 66 and shows the fabric piece 92 engaged by the pins 96 of the second chain 34. The groove 68 receives the pins 96 in the fabric engaged position of the plate 66. Similarly, as depicted in FIG. 5, a movable surface 60, with a groove 61 therein, is used to permit the pins 96 of the first chain 32 to engage the fabric piece 90 when the pins 96 are in the first path segment. The groove 61 corresponds to the first path segment. The solid line in FIG. 5 shows the surface 60 in the fabric-engaged position, while the dashed line denotes the disengaged position. The fabric piece 90 is placed on the surface 60 when it is in the disengaged position, and then the surface 60 is moved toward the first chain 32 so that the pins 96 engage the fabric piece 90. Like the groove 68, the groove 61 receives the pins 96 in the fabric-engaged position of the surface 60.

Figure 12A:
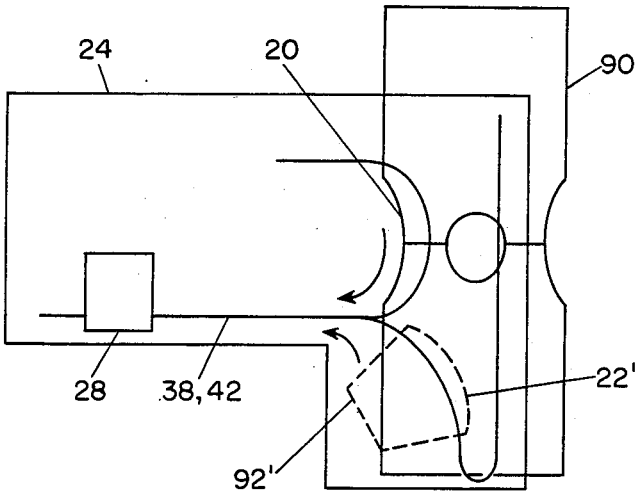
FIG. 12*a* is a simplified diagram of the FIG. 1 apparatus for the purpose of illustrating the operation thereof.
Figure 12B:
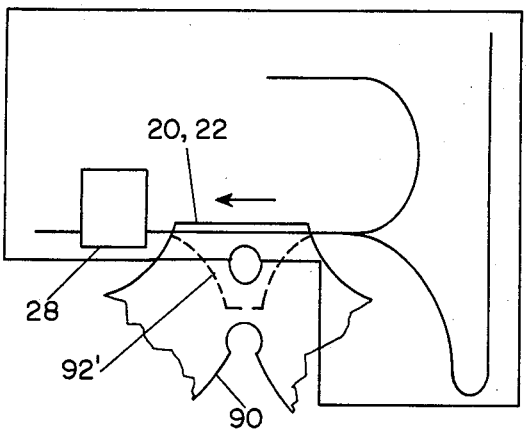
FIG. 12*b* is another simplified diagram of the FIG. 1 apparatus also for the purpose of illustrating the operation thereof.

Once the fabric pieces 90 and 92 are positioned on the pins of the chains 32 and 34, respectively, in the first and third path segments, respectively, the pieces move at approximately the same linear speed toward the sewing machine 28. This movement is more clearly illustrated in FIGS. 12*a* and 12*b*. FIG. 12*a* shows the fabric pieces 90 and 92′ just after they have been positioned on the corresponding chains; FIG. 12*b* shows the fabric pieces 90 and 92′ following movement to the second and fourth path segments, respectively. The movement of the chains after the fabric pieces are positioned thereon straightens the edges of the material and transforms the formerly concave edge 20 and the formerly convex edge 22 into straight edges, as FIG. 12*b* shows. The edges 20 and 22 and, therefore, the corresponding seam tracks on the fabric pieces 90 and 92′ are aligned in this position and may subsequently be sewn together by the sewing machine 28.

The dual-chain sewing machine depicted in FIGS. 1 and 2 not only aligns the fabric pieces 90 and 92 as they are brought from the first and third path segments to the second and fourth path segments, respectively, but also transfers the fabric piece 92 from the pins of the second chain 34 to the pins of the first chain 32. The way in which this operation is accomplished is depicted in FIGS. 3 and 7–10. The first chain 32 moves the fabric piece 90 from the first path segment into a fabric guiding slot 80 of the second path segment; simultaneously, the second chain 34 moves the fabric piece 92 from the third path segment into a fabric guiding slot 78 of the fourth path segment. The slot 78 intersects the slot 80 at an acute angle, with a wedge-shaped member 76 separating the slot 78 from the slot 80. Accordingly, when the chains 32 and 34 transport the fabric pieces 90 and 92, respectively, into the second path segment and the fourth path segment, respectively, the chains and the fabric pieces move toward each other. As the second chain 34 moves up toward the first chain 32, the fabric piece 92 on the second chain 34 contacts the pins 96 of the first chain 32 and is transferred to the first chain 32. Following the transfer, the first chain 32 transports the aligned fabric pieces 90, 92 in a fabric guiding slot 82 of the second path segment. The slot 82 is serially arranged after the slots 78 and 80. The fabric piece 92 is transferred from the second chain 34 to the first chain 32 because (a) the pins 96 of the chains 32 and 34 extend into the fabric guiding slots 78, 80, and 82, with the pins of the first chain 32 extending toward the pins of the second chain 34, and (b) following the engagement of the pins 96 of the first chain 32 with the fabric piece 92, the second chain 34 diverges from the first chain 32 in a portion of the fourth path segment that corresponds to the fabric guiding slot 82.

Figure 10:
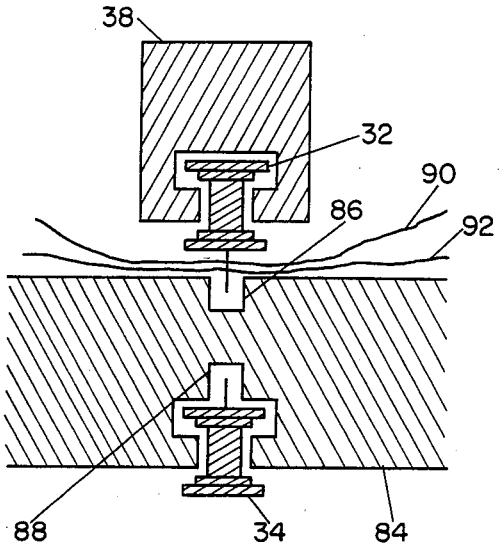
FIG. 10 is another cross-sectional view of a portion of the FIG. 1 apparatus.
Figure 14:
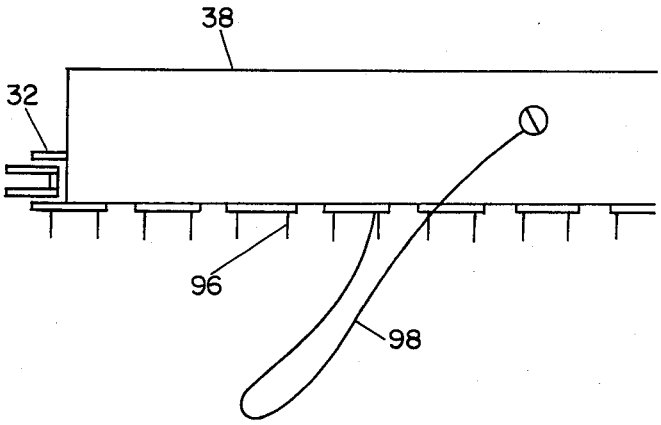
FIG. 14 is a detailed view of a portion of the FIG. 1 apparatus.

After the transfer, the first chain 32, with the pins 96 extending through the fabric pieces 90 and 92 and into a groove 86 of a plate 84, transports the fabric pieces 90 and 92 to the sewing machine 28, as illustrated in FIG. 10. Simultaneously, the plate 84 guides the second chain 34, with the pins 96 extending into a groove 88 of the plate 84, away from the first chain 32. FIG. 14 shows the end of the chain-guiding track 38 following the sewing machine and immediately before the sprocket 44. A wire loop member 98 is provided to guide the sewn fabric off the pins 96 of the chain 32.

As mentioned, the shaft of the sewing machine 28 may be provided with a magnet 35 and detector 33 for sensing the machine speed and providing pulses to stepper motor 47 to coordinate the motion of chains 32 and 34 with the speed of the sewing machine 28. As described in my referenced copending application, the stepper motor may be controlled by a programmed microprocessor which provides pulses to the stepper motor until the fabric pieces are detected by an edge detector on the sewing machine. The microprocessor can then activate the sewing machine 28 and coordinate the action of the motor 49 with the speed of the machine until the appropriate time following detection of the trailing edge of fabric by the edge detector. The microprocessor can also be used to briefly stop the chain to allow the venturi edge trimmer on the sewing machine to cut the sewing thread following the sewing of a set of pieces.

It should be recognized that the dual-chain sewing machine as described is suitable for use with machinery, not shown, which will automatically feed fabric pieces onto the receiving portions. It is contemplated that mechanisms similar to those described in any copending application may be suitable for this purpose.

An example of the invention is described for sewing the shoulder seam on a shirt. Those skilled in the art will recognize, however, that the invention can be readily adapted for sewing other seams and other garments. Further, it will be recognized that it is possible to use other arrangements for applying garment pieces to the pins 96 of either or both chains.

Although the invention has been described herein with respect to specific embodiments thereof, it will be understood that various modifications and variations may be made thereto without departing from the inventive concepts disclosed. All such modifications and variations are intended to be included within the spirit and scope of the appended claims.

I claim:

1. Apparatus for sewing first and second fabric plies along first and second seam tracks on said plies, comprising:

a first flexible, elongated carrier mounted and arranged for motion around a first continuous path, said first carrier having pins projecting from at least a portion thereof in a first transverse direction, said first path having a first path segment corresponding to said first seam track and a second path segment;

a second flexible, elongated carrier mounted and arranged for motion around a second continuous path, said second path having a third path segment corresponding to said second seam track and a fourth path segment generally parallel to and along said second path segment, said second carrier having pins projecting from at least a portion thereof in a second transverse direction, said second transverse direction being substantially opposite to said first transverse direction and toward said first carrier when said pin bearing portions of said first and second carriers are at said second and fourth segments of said paths, respectively;

fabric applying means, associated with said first and second carriers, for applying said fabric plies along said first and second seam tracks to said pin bearing portions of said first and second carriers when said pin bearing portions are along said first and third path segments, respectively;

carrier transport means for transporting said first and second carriers with substantially identical linear speed;

fabric guiding means for mating said pin engaged fabric plies along said second and fourth path segments in response to transport of said first and second carriers; and sewing apparatus for receiving and sewing said mated fabric plies.

2. Apparatus as specified in claim 1, wherein said first and second carriers comprise chains having chain links joined by link connecting pins with link connecting axes and wherein said pins extend from said chains parallel to said axes.

3. Apparatus as specified in claim 1, wherein each of said fabric applying means comprises a surface having a groove corresponding to one of said first and third path segments, said grooves being capable of receiving said pins.

4. Apparatus as specified in claim 3, wherein each of said surfaces is moveable toward and away from its respective carrier for applying said fabric to said pins.

5. Apparatus as specified in claim 1, wherein said first and second carriers comprise first and second chains and wherein said carrier transport means comprises a motor having a shaft with first and second sprockets for driving said first and second chains.

6. Apparatus as specified in claim 1, wherein said first carrier is arranged in a first guide along said second segment with said first carrier pins extending outwardly from said first guide, wherein said first carrier pins extend into first and second serially arranged fabric guiding slots along said second segment, wherein said second carrier is arranged in a second guide along said fourth segment with said second carrier pins extending outwardly from said second guide, wherein said second carrier pins extend into a third fabric guiding slot along said fourth segment and into said second slot, and wherein said third slot intersects said first slot at an acute angle and is serially arranged with said second slot, whereby, when said transport means transports said carriers, said first fabric ply is guided through said first and second slots and said second fabric ply is guided through said third and second slots and mated with said first ply in said second slot.

7. Apparatus as specified in claim 6, wherein said second guide is arranged to move said second carrier toward said first carrier in a portion of said fourth segment corresponding to said third slot and away from said first carrier in a portion of said fourth segment corresponding to said second slot, thereby disengaging said second fabric ply from said second carrier.

8. Fabric handling apparatus comprising:

a first elongated carrier having transversely extending pins and arranged for elongated motion along a first path serially through first and second fabric guiding slots with said pins extending into said first and second slots and a second elongated carrier having transversely extending pins and arranged for elongated motion along a second path serially through a third fabric guiding slot and said second fabric guiding slot with said pins extending into said third slot and into said second slot toward said pins of said first carrier.

9. Fabric handling apparatus as specified in claim 8, wherein said second carrier moves toward said first carrier along a portion of said second path corresponding to said third slot and wherein said second carrier moves away from said first carrier along a portion of said second path corresponding to said second slot.

10. Apparatus for sewing first and second fabric plies along first and second seam tracks on said plies, comprising:

a first continuous chain supported for linear motion around a first continous, generally horizontal path, said first chain having generally vertical link connecting axes and pins extending from said first chain parallel to said axes, said first path including a first path segment corresponding to said first seam track and a second path segment;

a second continuous chain supported for linear motion around a second continuous, generally horizontal path, said second chain having generally vertical link connecting axes and pins extending from said chain parallel to said axes and opposite to said first chain pins, said second path having a third path segment corresponding to said second seam track and a fourth path segment along said second path segment with said pins of said first and second chains vertically facing each other;

first and second fabric applying means, each including a surface with a groove in the shape of a corresponding one of said seam tracks, said surfaces arranged for movement toward and away from one of said first and second chains in the region of said corresponding first and third path segments;

chain transport means for driving said first and second chains in said linear motion;

fabric guiding means, including intersecting fabric guiding slots, having said pins extending into said slots along said second and fourth path segments; and a sewing machine, operated in coordination with said chain transport means, for sewing said plies along said seam tracks while said plies are transported by at least one of said chains.

11. Apparatus as specified in claim 10, wherein said carrier transport means comprises a stepper motor and wherein there is provided a sensor for sensing operating speed of said sewing machine and for providing pulses to said stepper motor for providing said coordination.

* * * * *